United States Patent [19]

Rao et al.

[11] 4,097,270

[45] Jun. 27, 1978

[54] REMOVAL OF MAGNESIUM FROM AN ALUMINUM ALLOY

[75] Inventors: Mannige Vikram Rao, Princeton Junction; Bernard H. Coyle, Jr., Voorhees; Peter C. J. Gallagher, Hightstown, all of N.J.

[73] Assignee: N L Industries, Inc., New York, N.Y.

[21] Appl. No.: 803,185

[22] Filed: Jun. 3, 1977

[51] Int. Cl.[2] ..... C22B 21/06

[52] U.S. Cl. ..... 75/68 R; 75/93 AC; 75/63

[58] Field of Search ..... 75/148, 68 R, 93 R, 75/93 AC, 63

[56] References Cited

U.S. PATENT DOCUMENTS

| | | | |
|---|---|---|---|
| 1,972,432 | 9/1934 | Girsewald | 75/148 |
| 2,054,427 | 9/1936 | Kirsebom | 75/148 |
| 2,511,775 | 6/1950 | Kelly et al. | 75/68 R |
| 3,620,716 | 11/1971 | Hess | 75/63 |
| 3,765,878 | 10/1973 | Bullough | 75/148 |

*Primary Examiner*—M. J. Andrews

*Attorney, Agent, or Firm*—Malcolm L. Sutherland; Gerald K. White

[57] ABSTRACT

Magnesium is removed from an aluminum alloy containing magnesium by reacting the alloy with silica to form silicon metal which dissolves in the aluminum alloy and magnesium oxide. The reaction between the alloy and the silica preferably is initiated as a suspension. The magnesium oxide formed is removed, e.g. by fluxing.

23 Claims, 7 Drawing Figures

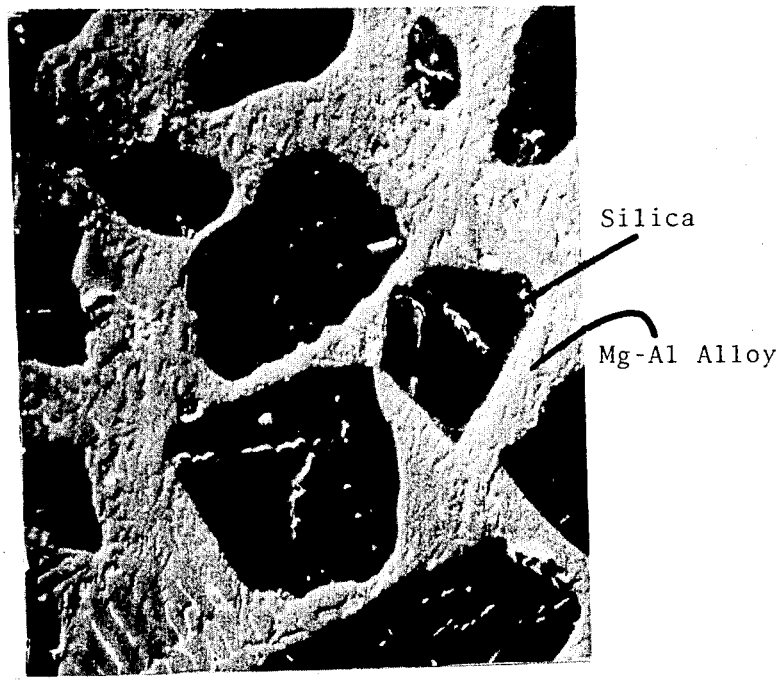
Figure 1. Secondary Electron Image of Cross Section Before Reaction
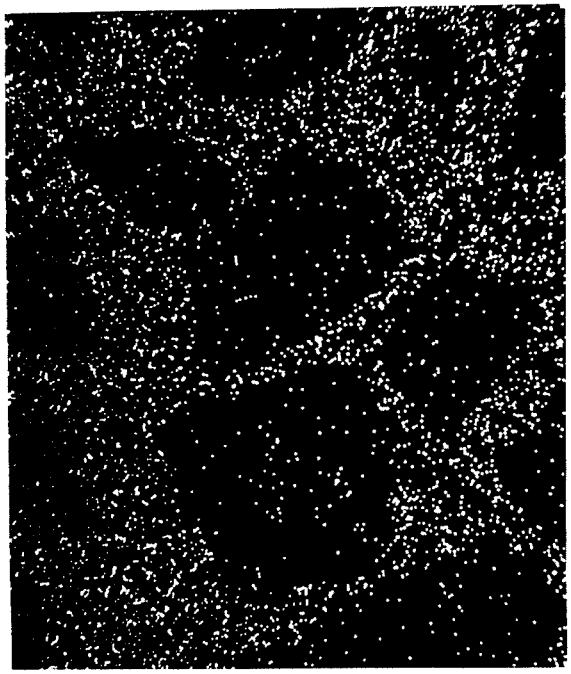
Figure 2. Superimposed Mg X-ray Image Before Reaction
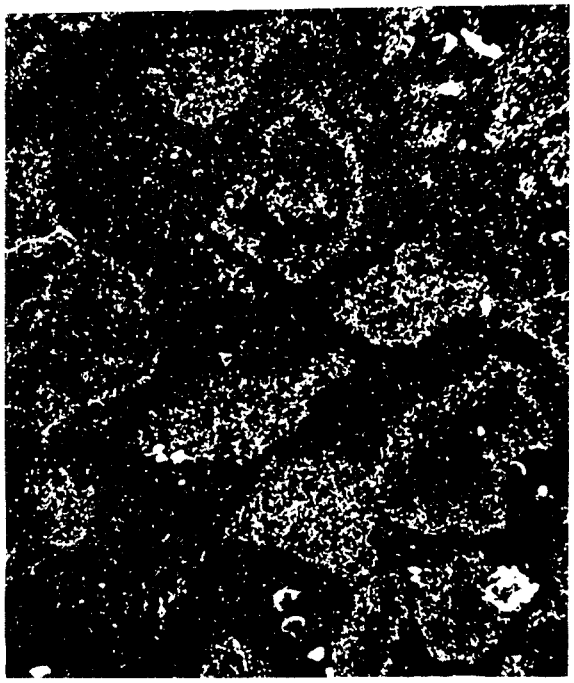
Figure 3. Superimposed Mg X-ray Image After Reaction

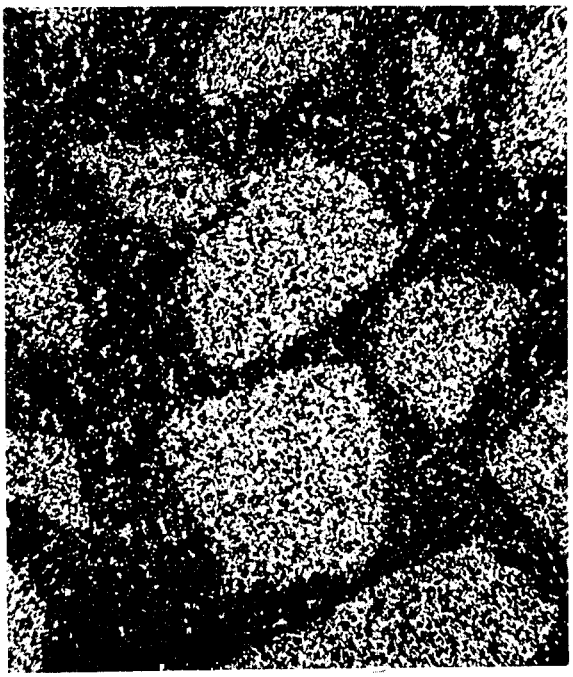
Figure 4. Superimposed Si X-ray Image Before Reaction
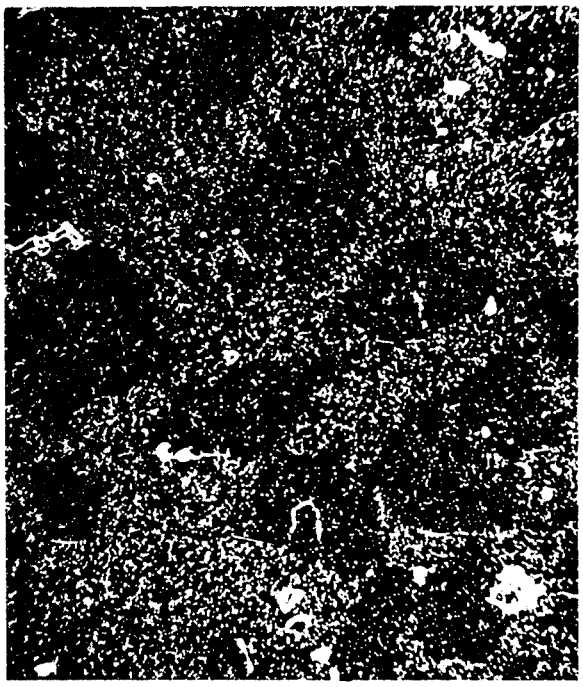
Figure 5. Superimposed Si X-ray Image After Reaction
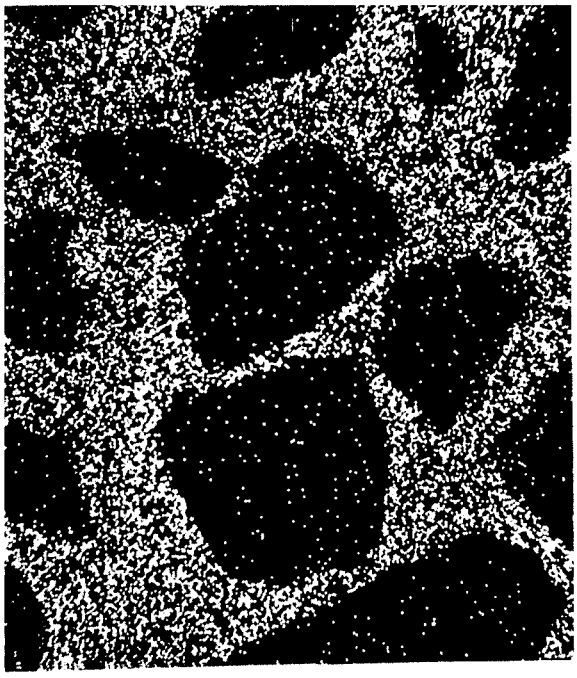
Figure 6. Superimposed Al X-ray Image Before Reaction
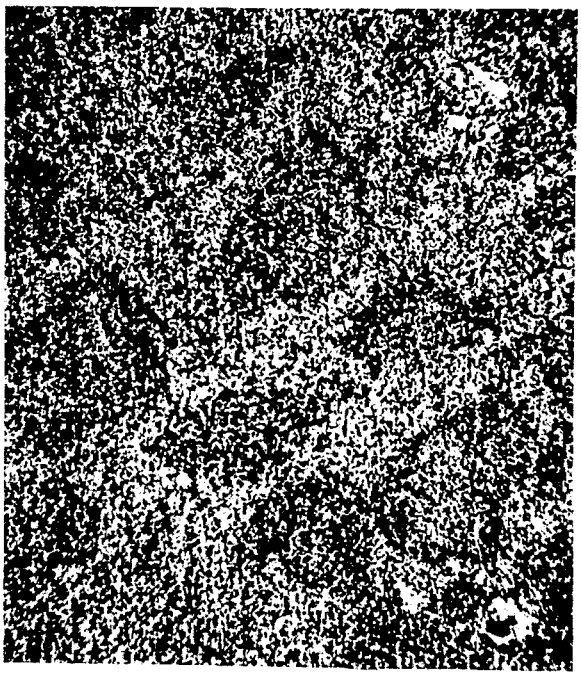
Figure 7. Superimposed Al X-ray Image After Reaction

REMOVAL OF MAGNESIUM FROM AN ALUMINUM ALLOY

BACKGROUND OF THE DISCLOSURE

In the aluminum industry, aluminum metal scrap is obtained in great quantities and must be processed to recover the aluminum values. Wrought aluminum scrap metal normally contains small quantities of silicon metal and large quantities of magnesium metal. Most of the secondary aluminum is used in casting applications. For most casting applications the magnesium metal should be removed from the aluminum metal and silicon added before it can be reused.

Various methods have been used in the past to remove the magnesium values from the aluminum metal. These processes include reacting the molten aluminum metal containing the magnesium with chlorine, chlorides and fluorides to form magnesium salts which will rise to the surface of the melt. U.S. Pat. No. 2,174,926 employs chlorine gas for this purpose while U.S. Pat. No. 3,025,155 employs chlorine gas in conjunction with carbon. Alkali metal salts are used in U.S. Pat. No. 2,195,217 while aluminum chloride is employed in U.S. Pat. No. 2,840,463. Cryolite is used in U.S. Pat. No. 1,950,967. All of these processes, however, are difficult to employ since they all produce by-products which pollute the atmosphere and the agents used are corrosive to the equipment employed.

In secondary aluminum smelting operations, normal aluminum metal products must be low in magnesium and may contain in excess of 10% by weight silicon. In the prior art process, although the magnesium metal may be removed, a separate process, must be employed to add silicon to the reused aluminum metal.

By employing the instant process with scrap aluminum metal, not only are the magnesium values removed but in addition, the silicon values are formed in the aluminum metal simultaneously as the magnesium values are removed.

SUMMARY OF THE INVENTION

The instant invention covers a process for removing magnesium from an aluminum alloy containing undesirable amounts of magnesium metal, e.g. up to about 10% by weight, or more, magnesium metal, and simultaneously producing silicon which dissolves in the aluminum alloy, which comprises reacting silica with the magnesium in the aluminum alloy to form silicon metal which dissolves in the aluminum alloy and oxide of magnesium, and removing the oxide of magnesium from the aluminum alloy. The aluminum alloy also reacts with the silica particles to form aluminum oxide and additional silicon metal which also dissolves.

It is known that it is difficult to incorporate solid particles into molten metal of a greater density since the solid particles tend to float on the surface of the molten metal and therefore are not mixed in by the molten metal.

U.S. Pat. Nos. 2,793,949 and 3,936,298 are directed to processes for adding various inert solid particles, such as silicon carbide and the like, to molten metal to alter the physical characteristics of the metal, such as increasing the wear resistance of the metal. According to these patents the inert solid particles may be added to molten metals by adding the solid particles to a semi-solid mass of molten metal which retains the solid particles in suspension long enough for the semi-solid mass to "wet" the solid particles and thereby allowing the inert solid particles to be incorporated into the molten metal which alters the physical characteristics of the treated metal.

In contrast to these prior art processes, the salient feature of the present invention comprises adding silica particles to an aluminum alloy containing magnesium and the magnesium reacts with the silica particles to form magnesium oxide and an alloy of aluminum containing silicon metal.

In the instant invention the silica particles preferably are incorporated into the molten metal by first forming a suspension containing the molten aluminum alloy and solid particles suspended therein and then adding the silica particles to the suspension, with stirring. The silica particles react with the aluminum alloy to form silicon metal which dissolves in the aluminum alloy and oxides of magnesium and aluminum which are removed, e.g. by fluxing. It has been found that when the silica is added to a liquid-solid suspension, the silica efficiency is increased and the reaction of the silica with the magnesium and aluminum is more rapid.

BRIEF DESCRIPTION OF DRAWINGS

FIG. 1 is a photomicrograph of an aluminum alloy intimately mixed with silica particles.

FIG. 2 is a superimposed magnesium X-ray image illustrating the distribution of magnesium values prior to reaction with silica.

FIG. 3 is a superimposed magnesium X-ray image illustrating the distribution of magnesium values after reaction with silica.

FIG. 4 is a superimposed silicon X-ray image illustrating the distribution of silicon values prior to the reaction of silica with magnesium and aluminum.

FIG. 5 is a superimposed silicon X-ray image illustrating the distribution of silicon values after the reaction of silica with magnesium and aluminum.

FIG. 6 is a superimposed aluminum X-ray image illustrating the distribution of aluminum values prior to the reaction with silica.

FIG. 7 is a superimposed aluminum X-ray image illustrating the distribution of aluminum values after the reaction with silica.

DESCRIPTION OF THE PREFERRED EMBODIMENTS

As stated above silica particles are added to the molten aluminum which contains solid particles suspended therein. The suspension of said particles may be formed by many methods. One such method which may be employed is to melt the aluminum alloy containing magnesium and to add to the molten metal, with stirring, any compatible solid material which does not interfere with the desired reaction or adversely affect the properties of the alloy product, see U.S. Pat. Nos. 2,793,949 and 3,936,298, to form the solid suspension in the molten aluminum alloy containing the magnesium. Particulate material which is accepted by the molten aluminum yet non-reactive therein include, for example, particles of high melting temperature metal or alloy which is relatively insoluble in aluminum-magnesium alloy. As more fully described below, particulate material which is accepted by the molten aluminum and reactive therein, with the reaction products characterized by being non-harmful to the process, can also be used. For example, the particulate material can be largely silica which has already been partially reacted so as to have a chemically reduced surface layer. While acting as an entrapping agent the particles react further and remove magnesium and add silicon which is desirable in the process.

A preferred method, however, is to melt the aluminum alloy containing the magnesium and slowly cool the molten alloy with stirring to produce a mixture of solid alloy particles suspended in the liquid aluminum alloy.

The silica particles are added to the suspension and the magnesium and aluminum react with the silica to form magnesium and aluminum oxides and, at the same time, silicon metal which dissolves in the aluminum alloy.

It has been found that magnesium values up to about 10% or more, e.g. about 0.3 to 10%, by weight, of the molten aluminum alloy can be effectively reduced by this method to substantially any desired percentage, e.g. to below 0.3%; preferably below 0.1% by weight of the alloy, and as low as about 0.01% by weight. It is preferred to add silica particles which have an active surface to the aluminum alloy containing magnesium. These activated silica particles may be formed in many ways. One convenient way to form the activated silica particles is to heat particles of silica to remove the physically and chemically bonded water and other contaminants from the surface of the silica.

The amount of silica particles to be added to the aluminum alloy containing the magnesium should be sufficient to react with the magnesium in the alloy and produce magnesium oxide, which can be easily removed, thereby producing an alloy of reduced magnesium content. Generally, the amount of silica added is that amount sufficient to react with the magnesium and effectively reduce the magnesium content in the alloy the desired amount. More particularly, it is desired to add sufficient silica to reduce the magnesium content of the alloy to below about 0.33% by weight, preferably to below about 0.1% by weight. Generally, from about 0.5 to 25 pounds, preferably about 5 to 25 pounds silica, for each pound of magnesium metal present in the aluminum alloy, is used to meet these objectives. Preferably, however, the amount of silica added in any single operation or batch should not exceed, by weight, about one part silica for each part of aluminum alloy; otherwise the mass can become too thick or solid. If, however, it is desirable to produce an alloy of aluminum containing higher percentages of silicon, additional silica can be added to the semi-solid mass after the initially added silica has completed its reaction with the magnesium and aluminum metals.

When the silica is added to the suspension of the aluminum alloy the mixture should be stirred to allow the magnesium in the alloy to react with the surface of the silica particles to form a layer of magnesium oxide on the silica particles. In order to reduce the magnesium content to below about 0.3% by weight of the alloy, however, it is necessary to employ the excess of silica described above (i.e. up to 25 pounds of silica for each pound of magnesium). When this amount of silica is used, the magnesium reacts first with the silica to form magnesium oxide and then the aluminum values react with the silica particles to form aluminum oxide. The silica is reduced to metal and dissolves in the aluminum alloy. The magnesium and aluminum oxides are collected on the top of the molten alloy and removed in accordance with conventional practice. For this purpose, a conventional fluxing agent can be added to the molten alloy.

It is believed that the magnesium reacts with the silica particles substantially immediately and forms magnesium oxide and silicon metal on the surface of the silica particles. After most of the magnesium is consumed, the aluminum starts to react with the silica particles and forms aluminum oxide and silicon metal which eventually replaces the silica particles; the silicon metal formed dissolves in the aluminum alloy.

Although the above-described procedure produces a satisfactory product in a straight forward manner, it has been found in actual practice that a portion of the flux, used in the removal of the magnesium oxide and aluminum oxide from a previous batch, remains in the reaction vessel. When a subsequent portion of the aluminum alloy containing the magnesium and the silica particles are added to the vessel to produce a subsequent batch of aluminum alloy from which the magnesium has been removed, the residual flux remaining in the vessel floats to the top of the batch and reacts substantially immediately with the silica particles as they are added to the vessel. This reaction renders the silica particles inactive and therefore little or no reaction between the silica particles and the magnesium takes place.

In order to overcome this difficulty, it has been discovered that it is possible to produce an intermediate product by adding all of the silica particles (necessary to react with all of the magnesium in the aluminum alloy) to a minor portion, generally less than about one-third, typically about 10%, or 15%, to about 30% by weight of the aluminum alloy, and allowing the silica particles to partially react with the magnesium content of this portion of the aluminum alloy. The intermediate product should contain sufficient silica to complete the reaction both with the magnesium in the remainder, i.e. the major portion, of the aluminum alloy and any magnesium remaining unreacted in the minor portion as well as add the desired amount of silicon to the alloy. Generally, the intermediate product will contain from about 0.1 to about 1 part of silica, preferably about 0.2 to 0.5, or 1 part silica for each part of aluminum metal present in the intermediate product.

This intermediate product when formed may be either solidified and stored or may be added to the major portion of the aluminum alloy containing the magnesium in order to reduce the magnesium values in the alloy by reacting the silica values in the intermediate product with the magnesium values present in the major portion of the magnesium-aluminum alloy employed.

This intermediate product is prepared by taking an aluminum alloy containing magnesium and forming a suspension of said alloy and adding thereto silica particles, with stirring, in the desired amount, e.g. from about 0.1 to 1 part by weight for each part of aluminum alloy present in the mixture. The magnesium values will react rapidly with the silica particles to form silicon metal and magnesium oxide on the silica particles. As soon as the magnesium values have reacted, the mass should be either solidified and stored for further use or added to an aluminum alloy containing magnesium, the amount of the mass added containing from 0.5 to 25 parts of silica for each part of magnesium present in the total amount of aluminum alloy to be treated.

If the reaction in the intermediate product is allowed to continue, the aluminum values start to react with the silica particles to form aluminum oxide and silicon metal after the magnesium values have substantially reacted with the silica particles.

Photomicrographs are presented to show that the magnesium metal in the aluminum alloy reacts preferentially with the silica particles to form magnesium oxide and silicon metal on the surface of the silica particles and then the aluminum metal reacts with silica particles to form aluminum oxide and silicon metal, the aluminum oxide replacing the silica particles while the silicon metal forms an alloy with the aluminum metal.

FIG. 1 shows a cross-section of an aluminum alloy (containing 1% wt. Mg and 8.5% wt. silicon) intimately mixed with silica particles. The dark areas are the silica particles while the light area is the alloy matrix.

FIGS. 2 and 3 are superimposed magnesium x-ray images showing the distribution of the magnesium values before and after reaction with the silica. FIG. 2 shows that the magnesium values, illustrated as white dots, are distributed in the alloy before the reaction while FIG. 3 shows that the magnesium values in the alloy matrix have migrated to the surface of the silica particles, the dark areas, and have reacted with the silica to form magnesium oxide.

FIGS. 4 and 5 are superimposed silicon x-ray images which show the distribution of the silicon values before and after the reaction of the silica with the magnesium and aluminum values. FIG. 4 shows that the silicon values, the white dots, are present in the silica particles, white areas, at the onset of the reaction while FIG. 5 shows the migration of the silicon values from the silica particles, dark areas, to the aluminum alloy matrix. This is illustrated by the substantial absence of white dots in the area where the silica particles were originally present and the presence of the high intensity of white dots in the alloy matrix which was formerly substantially free of white dots (see FIG. 4).

FIGS. 6 and 7 are superimposed aluminum x-ray images showing the distribution of the aluminum values, the white dots, before and after the reaction with the silica. FIG. 6 shows the absence of aluminum in the silica particles, dark areas, before reaction while FIG. 7 shows the presence of alumina, white dots, in the areas previously occupied by silica.

Although most of the magnesium values react with the silica particles before the aluminum, in order to reduce the magnesium content of the alloy to the lowest desired extent, i.e. below 0.3% by weight of the alloy, it is necessary to add the above described excess of silica to the alloy. Using this amount of silica produces in the alloy a mixture of magnesium oxide and aluminum oxide which is removed in order to produce an aluminum alloy containing a small amount of magnesium.

The aluminum metal containing the silicon metal is then recovered by pouring into molds after the magnesium and aluminum oxides have been removed.

In order to describe the instant invention in more detail, the following examples are presented. The percentages are all by weight.

EXAMPLE 1

In this example 5.05 pounds of an aluminum alloy containing 0.80% magnesium metal and 1.8% silicon metal were melted in a vessel. After the alloy was melted, the temperature was slowly lowered to 1180° F. with rapid agitation to form a suspension of solid particles in the molten aluminum alloy. The amount of solid particles present in the molten alloy was about 30–40% by weight of the total alloy.

0.49 pound of silica sand was added to this agitated suspension while maintaining the temperature of 1180° F. After all of the silica was added, the suspension containing the silica particles was held at 1180° F. for 30 minutes during which the silica particles were partially reacted with the alloy and then the mass was heated to 1250° F. to melt the solid alloy particles and the molten mixture was held at 1250° F. for 1.5 hours to allow the magnesium metal present in the alloy to react with the silica sand to product silicon metal and magnesium and aluminum oxides.

0.32 pound of a dry flux (metal salts containing 15% fluoride by weight), sold as Coveral II and manufactured by Foseco Minsep Inc., was added as a fluxing agent and the magnesium and aluminum oxides were collected on the top of the melt and removed from the molten alloy.

The final aluminum alloy produced after casting contained 4.1% silicon and only 0.06% magnesium.

EXAMPLES 2–3

In these examples the procedure described in Example 1 was repeated except that the amount of the various ingredients and the temperatures employed were varied.

The operation details and the results obtained are recorded in Table I along with those of Example 1.

TABLE I

| Example Number | #1 | #2 | #3 |
|---|---|---|---|
| Alloy Melt weight (lbs) | 5.05 | 5.5 | 7.58 |
| Initial Mg (%) | 0.8 | 0.34 | 0.68 |
| Initial Si (%) | 1.8 | 1.8 | 10.0 |
| Starting temperature (° F) | 1180 | 1180 | 1180 |
| Silica added (lbs) | 0.49 | 0.36 | 0.59 |
| Reaction Time in suspension (Min) | 30 | 40 | 40 |
| Temperature of Molten mass (° F) | 1250 | 1450 | 1550 |
| Reaction Time in molten mass (Min) | 90 | 180 | 210 |
| Flux Compound added | Dry | Dry | Dry |
| Amount of Flux (lbs) | 0.32 | 0.46 | 0.65 |
| Loading (lbs $SiO_2$/lb Mg) | 12.1 | 23.3 | 11.5 |
| Final Mg (%) | 0.06 | 0.015 | 0.02 |
| Final Si (%) | 4.1 | 2.7 | 11.8 |

The following examples are presented to describe in more detail the preparation of the intermediate product and its use in reacting with an additional amount of aluminum alloy containing the magnesium.

EXAMPLE 4

In this example 705 pounds of an aluminum alloy containing 1.1% magnesium metal were melted in a reverberatory furnace by heating the alloy to 1350° F. After the aluminum alloy was melted, 126 pounds of metal were transferred to a separate vessel and the temperature was lowered to 1040° F. with stirring to form a suspension of solid alloy particles suspended in the molten alloy. The amount of solid particles present in the molten alloy was about 35% of the total alloy by weight.

To this agitated suspension, 99 pounds of silica sand, previously heated to 1600° F. to activate the surface, were added in increments over a period of 20 minutes while maintaining a temperature of 968° F. The total amount of silica added was sufficient to produce a heterogeneous mixture of the aluminum alloy containing approximately 44% silica by weight. After all of the silica particles were added and mixed with stirring for 1–2 minutes, the entire mixture was transferred back to the reverberatory furnace. In this particular example a sample of the intermediate product had the following composition:

56.0% Aluminum metal
41.7% Silica
2.3% Magnesium oxide Aluminum oxide

After the intermediate product had been added, the temperature of 1425° F. was maintained for 2.5 hours to allow the magnesium metal present in the major portion of the alloy to react with the silica particles present in the intermediate product to produce silicon metal and oxides of magnesium and aluminum.

When the magnesium had been lowered to below 0.1%, 65 pounds of smelter's flux (sodium, potassium chloride and potassium aluminum fluoride) were added as a fluxing agent and the magnesium and aluminum oxides were reacted and collected on the top of the mass and removed from the molten alloy.

The final aluminum alloy produced after casting contained 10.8% silicon and 0.04% magnesium.

EXAMPLES 5–7

In these examples the procedure described in Example 4 was repeated except that the amounts of the various ingredients and the temperatures employed were varied.

The operational details and the results obtained are recorded in Table II along with those of Example 4.

EXAMPLE 8

In this example the intermediate product was prepared according to the procedure described in Example 4 except that the reaction between the silica particles and the aluminum was allowed to proceed for approximately an hour instead of 10–20 minutes. This extended time of reaction allowed the aluminum metal to react with the silica particles to produce aluminum oxide and silicon metal. The final intermediate product possessed the following analysis:

TABLE II

| Example Number | #4 | #5 | | #6 | | | #7 |
|---|---|---|---|---|---|---|---|
| Intermediate Product Prepared from Portion of the Al Alloy to be Treated | | First Batch | Second Batch | First Batch | Second Batch | Third Batch | |
| Amount Al Alloy (lbs) | 126 | 55 | 66 | 52.5 | 61.5 | 60 | 120 |
| Amount $SiO_2$ Add (lbs) | 99 | 41 | 45 | 20 | 20 | 20 | 85 |
| Loading (lbs $SiO_2$/lb Al) | .44 | .43 | .40 | .28 | .25 | .25 | .415 |
| Temp at $SiO_2$ Add ° F | 1040 | — | 1058 | 1040 | 1013 | 986 | 1022 |
| Temp at End $SiO_2$ Add ° F | 968 | 1067 | 1040 | 1022 | 977 | 968 | 950 |
| $SiO_2$ Add & Mix Time (min) | 20 | 15 | 20 | 15 | 15 | 15 | 15 |
| $SiO_2$ Preheat ° F | 1600 | 1600 | 1600 | 1600 | 1600 | 1600 | 1600 |
| Amount Product Made (lbs) | 225 | 96 | 111 | 72.5 | 81.5 | 80 | 205 |
| % $SiO_2$ | 41.7 | — | 37.3 | 23.7 | 18.5 | 23.7 | 40.8 |
| % MgO + $Al_2O_3$ | 2.3 | — | 2.7 | 3.9 | 6.0 | 1.3 | 0.7 |
| % Metal | 56.0 | — | 60.0 | 72.4 | 75.5 | 75 | 58.5 |
| Amount Al Melted (lbs) | 705 | 612 | | | 701.5 | | 700 |
| % Mg | 1.1 | .58 | | | .77 | | 1.33 |
| % Si | 6.25 | 5.8 | | | 5.6 | | 6.0 |
| Amount of $SiO_2$ Contained in Intermediate Product/lb Mg Treated | 12.8 | 24.2 | | | 11.1 | | 9.0 |
| Amount flux (lbs) | 65 | 85 | | | 60 | | 90.5 |
| Fluxing Temp ° F | 1400±50 | 1400±50 | | | 1400±50 | | 1400±50 |
| Amount Al Cast (lbs) | 637.5 | 544.4 | | | 612.2 | | 654 |
| % Mg | .04 | .04 | | | .06 | | .033 |
| % Si | 10.8 | 7.8 | | | 6.50 | | 9.4 |

54.8% Al
21.1% MgO $Al_2O_3$
24.1% Si

Using the procedure described in Example 4, 422 pounds of this intermediate product were used to treat 1505 pounds of an aluminum alloy containing 0.79% magnesium and 5.8% silicon.

The intermediate product described above was added to the molten magnesium-aluminum alloy at 1308° F. for 4½ hours with periodic rabbling. During this period, the magnesium metal in the aluminum alloy reacted with the unreacted silica particles.

190 pounds of smelter's flux, sold as Rossborough A-103 and manufactured by Amcor Division of Rossborough Corporation, were added as a fluxing agent and the magnesium oxide and aluminum oxide formed were removed from the aluminum alloy. The final alloy possessed the following analysis: 11.7% silicon and 0.002% magnesium.

EXAMPLES 9–11

In these examples the procedure of Example 8 was repeated to produce the intermediate products. These intermediate products were then used to treat the major portion of the magnesium-aluminum alloy.

The operational details and results obtained in Examples 8–11 are recorded in Table III.

From the above description and by the examples presented, it has been shown that magnesium metal present in an aluminum alloy may be removed from the metal and replaced by silicon metal when the alloy is treated with silica. Apparently the magnesium metal in the aluminum alloy reacts with the silica particles to form magnesium oxide and silicon metal which dissolves in the aluminum metal.

TABLE III

| Example Number | #8 | #9 | #10 | #11 |
|---|---|---|---|---|
| Aluminum Alloy - To Be Treated (lbs) | 1505 | 1499 | 1504 | 1504 |
| % Mg | 0.79 | 0.66 | 0.79 | 0.64 |
| % Si | 5.8 | 6.1 | 5.0 | 6.4 |
| Amount of $SiO_2$ Contained in Intermediate Product/lb Mg Treated | 8.5 | 8.0 | 5.7 | 9.9 |
| Melt Temp at Product Addition ° F | 1176 | 1214 | 1312 | 1137 |

TABLE III-continued

| Example Number | #8 | #9 | | #10 | #11 |
|---|---|---|---|---|---|
| Fluxing Agent Added Amount (lbs) | 190 | 127 | | 66 | 96 |
| Fluxing Temperature ° F | 1308 | 1292 | | 1214 | 1214 |
| Final Aluminum Alloy | | | | | |
| % Si | 11.7 | 10.1 | | 10.7 | 10.8 |
| % Mg | 0.002 | 0.008 | | 0.07 | 0.02 |
| Intermediate Product Added (lbs) | 422 | 389 | | 382 | 384 |
| % $SiO_2$ | 24.1 | 20.4 | | 17.8 | 24.8 |
| % Al Metal | 54.8 | 44.7 | | 53.8 | 53.1 |
| % MgO | 21.1 | 34.9 | | 28.4 | 22.1 |
| Loading (lbs $SiO_2$/lb Al in product) | .45 | .45 | | .46 | .47 |
| Temperature (° F) of Sand Added | | | 1072±21 | | |
| $SiO_2$ Add and Mix Time (min) | | | 54.5±23.1 | | |

The process is direct and simple to operate and accomplishes the dual function of removing magnesium metal from the aluminum alloy and at the same time forms silicon metal which dissolves in the aluminum metal.

While this invention has been described and illustrated by the examples shown, it is not intended to be strictly limited thereto, and other variations and modifications may be employed within the scope of the following claims.

We claim:

1. A process for reducing the amount of magnesium metal from an aluminum alloy containing magnesium which comprises reacting the aluminum alloy containing magnesium metal with silica having a chemically reduced surface layer to form silicon metal which dissolves in the aluminum alloy and magnesium oxide, and removing the magnesium oxide from said aluminum alloy.

2. A process for removing magnesium metal from a molten aluminum alloy containing magnesium metal and simultaneously producing silicon metal which dissolves in said aluminum alloy which comprises forming a suspension containing said molten aluminum alloy and solid particles suspended therein and adding silica particles to said suspension in an amount sufficient to react with the magnesium metal in said aluminum alloy to form magnesium oxide and silicon metal, said silicon metal dissolving in said aluminum alloy, and removing said magnesium oxide from the aluminum alloy containing said dissolved silicon.

3. A process for reducing the magnesium metal content from a molten aluminum alloy containing magnesium metal and simultaneously producing silicon metal which dissolves in said aluminum alloy which comprises forming a suspension containing molten aluminum alloy and solid particles suspended therein and adding silica particles to said suspension in an amount sufficient to react with the magnesium and aluminum metals in said aluminum alloy to form magnesium and aluminum oxides and silicon metal, said silicon metal dissolving in said aluminum alloy, and removing said magnesium and aluminum oxides from the aluminum alloy containing said dissolved silicon.

4. Process according to claim 3 in which said molten aluminum alloy containing magnesium metal contains up to about 10% by weight magnesium metal and said silica is added in an amount sufficient to reduce the magnesium metal content in the aluminum alloy containing said dissolved silicon to below about 0.3% by weight.

5. Process according to claim 4 in which the silica particles are added in the amount from about 0.5 to 25 pounds for each pound of magnesium metal present in the aluminum alloy.

6. Process according to claim 5 wherein the amount of silica added at any one time does not exceed on a weight basis the amount of aluminum alloy present.

7. Process according to claim 3 wherein said suspension is formed by melting the aluminum alloy containing magnesium metal and cooling the molten alloy to produce a mixture of solid alloy particles suspended in the liquid alloy, said solid alloy particles comprising said solid particles.

8. A process for removing a desired amount of magnesium metal from a molten aluminum alloy containing an undesirable high content of magnesium metal and simultaneously producing silicon metal which dissolves in the aluminum alloy which comprises forming a suspension containing said molten aluminum alloy and solid particles of said alloy suspended therein and adding silica particles to said suspension to react with the magnesium and the aluminum metals in said alloy to form magnesium and aluminum oxides and silicon metal which dissolves in the aluminum alloy, the silica particles being added in amount sufficient to reduce the magnesium metal content of said alloy the desired amount, said amount of silica added being from about 0.5 to 25 pounds silica for each pound of magnesium metal present in the aluminum alloy, heating the treated mass to melt the solid alloy particles, maintaining the temperature to complete the reaction and removing the magnesium and aluminum oxides from said aluminum alloy containing said silicon.

9. Process according to claim 8 wherein the aluminum alloy containing an undesirable amount of magnesium metal contains up to about 10% by weight magnesium metal.

10. Process according to claim 9 wherein sufficient silica is added to reduce the content of the magnesium metal in the aluminum alloy containing said silicon to below about 0.3% by weight.

11. Process according to claim 10 wherein the silica is added in an amount of about 5 to 25 pounds silica for each pound of magnesium metal in the aluminum alloy containing an undesirable amount of magnesium.

12. A product useful for treating an aluminum alloy containing magnesium to remove the magnesium therefrom and to produce silicon metal which dissolves in the aluminum alloy, said product comprising an aluminum alloy, silica and magnesium oxide, said product containing from 0.1 to 1 part of silica for each part of aluminum alloy present in said product, all of the parts expressed on a weight basis.

13. A process for producing a product useful for treating an aluminum alloy containing magnesium to remove the magnesium therefrom and simultaneously forming silicon metal which dissolves in the aluminum alloy which comprises forming a suspension containing molten aluminum alloy and solid particles suspended therein, and adding silica particles to said suspension to product a mixture containing the aluminum alloy, silica particles and magnesium oxide, the amount of silica particles added being from about 0.1 to 1 part for each part of aluminum present in said product, said parts expressed by weight.

14. A process for producing a product useful for treating an aluminum alloy containing magnesium to remove the magnesium therefrom and simultaneously forming silicon metal which dissolves in said aluminum alloy which comprises forming a suspension of molten aluminum alloy and solid particles of said aluminum alloy suspended therein, adding silica particles to said suspension to produce a mixture containing the aluminum alloy, silica particles, aluminum oxide and magnesium oxide, the amount of silica particles added being from about 0.1 to 1 part for each part of aluminum present in said product, said parts expressed by weight.

15. A process for removing a desired amount of magnesium metal from an aluminum alloy containing up to about 10% magnesium and simultaneously producing silicon metal which dissolves in said aluminum alloy which comprises melting said aluminum alloy and adding thereto a treating agent in an amount sufficient to remove the desired amount of magnesium from the alloy and simultaneously to form silicon metal which dissolves in aluminum alloy, said treating agent comprising an aluminum alloy, silica particles and magnesium oxide, said treating agent containing from about 0.1 to 1 part by weight of silica for each part of aluminum present in said treating agent, maintaining the temperature of the mixture for a sufficient time for the treating agent to react with the magnesium in the aluminum alloy to produce silicon metal which dissolves in the aluminum alloy and magnesium oxide, adding a fluxing agent to remove the magnesium oxide, and recovering the aluminum alloy containing the dissolved silicon and in which the magnesium has been lowered by the desired amount.

16. Process according to claim 15 in which the aluminum alloy containing the dissolved silicon contains less than about 0.1% magnesium.

17. Process according to claim 15 in which the aluminum alloy containing the dissolved silicon contains less than about 0.3% magnesium.

18. A process for removing a desired amount of magnesium metal from an aluminum alloy containing an undesired amount of magnesium and simultaneously producing silicon metal which dissolves in the aluminum alloy which comprises melting the aluminum alloy and adding thereto a treating agent in an amount sufficient to remove the desired amount of magnesium from the alloy and simultaneously to form silicon metal which dissolves in said aluminum alloy, said treating agent comprising an aluminum alloy, silica particles, magnesium oxide and aluminum oxide, said treating agent containing from about 0.1 to 1 parts by weight of silica for each part of aluminum present in said treating agent, said treating agent being added in an amount sufficient to provide in the molten aluminum alloy from about 0.5 to 25 pounds silica for each pound of magnesium present in the aluminum alloy, maintaining the temperature of the reaction mixture for a sufficient time for the silica in the treating agent to react with the magnesium and aluminum in the aluminum alloy to produce magnesium and aluminum oxides and silicon metal which dissolves in the aluminum alloy, adding a fluxing agent to remove the magnesium and aluminum oxides, and recovering the aluminum alloy containing the silicon in which the magnesium has been lowered by the desired amount.

19. A process for removing magnesium metal from an aluminum alloy containing up to about 10% magnesium and simultaneously producing an aluminum alloy containing silicon dissolved therein which comprises forming a suspension of a minor portion of said molten aluminum alloy and solid particles suspended therein and adding to said suspension silica particles in an amount sufficient to react with a desired amount of the magnesium metal in said alloy to form a reacted mass comprising magnesium oxide and an aluminum alloy containing dissolved silicon, the amount of said silica particles added being from 0.1 to 1 parts by weight of silica for each part of aluminum present in said minor portion of the alloy, adding said reacted mass to the major portion of said aluminum alloy containing magnesium, said major portion being present in the molten state, maintaining the temperature for sufficient time for the magnesium in the aluminum alloy to react with the silica particles in the reacted mass to form magnesium oxide and an aluminum alloy containing silicon dissolved therein, and removing the magnesium oxide, thereby producing an aluminum alloy containing dissolved silicon and in which the magnesium has been lowered.

20. Process as defined in claim 19 wherein the reacted mass added to the major portion of said aluminum alloy containing magnesium contains sufficient silica to react with the magnesium and produce magnesium oxide so that the aluminum alloy containing dissolved silicon contains less than 0.1% magnesium.

21. Process as defined in claim 20 wherein the total amount of silica added to the total amount of aluminum alloy is from about 5 to 25 pounds of silica for each pound of magnesium.

22. Process as defined in claim 21 wherein the silica is present in said minor portion in an amount of about 0.2 to 0.5 parts by weight per part of aluminum present.

23. Process as defined in claim 22 wherein said solid particles in said suspension are solid particles of said aluminum alloy containing magnesium.

* * * * *